US012503845B2

(12) United States Patent
Park

(10) Patent No.: US 12,503,845 B2
(45) **Date of Patent: *Dec. 23, 2025**

(54) SELF-BUILDING KIT SYSTEM

(71) Applicant: Sangwook Park, Seoul (KR)

(72) Inventor: Sangwook Park, Seoul (KR)

( * ) Notice: Subject to any disclaimer, the term of this patent is extended or adjusted under 35 U.S.C. 154(b) by 324 days.

This patent is subject to a terminal disclaimer.

(21) Appl. No.: 18/044,367

(22) PCT Filed: Jun. 17, 2021

(86) PCT No.: PCT/KR2021/007610
§ 371 (c)(1),
(2) Date: Mar. 7, 2023

(87) PCT Pub. No.: WO2022/055084
PCT Pub. Date: Mar. 17, 2022

(65) Prior Publication Data

US 2023/0358031 A1 Nov. 9, 2023

(30) Foreign Application Priority Data

Sep. 8, 2020 (KR) ..... 10-2020-0114439

(51) Int. Cl.
*E04B 1/26* (2006.01)

(52) U.S. Cl.
CPC .... *E04B 1/2604* (2013.01); *E04B 2001/2636* (2013.01); *E04B 2001/2672* (2013.01); *E04B 2001/2692* (2013.01)

(58) Field of Classification Search
CPC ..... E04B 1/34315; E04B 1/34321; E04B 1/34326; E04B 1/34331; E04B 1/61; E04B 1/6104; E04B 1/6187; E04B 2001/2636
See application file for complete search history.

(56) References Cited

U.S. PATENT DOCUMENTS 5,771,649 A 6/1998 Zweig
10,156,067 B2 * 12/2018 Albright ..... F16B 5/07
(Continued)

FOREIGN PATENT DOCUMENTS

CN 2791166 Y 6/2006
DE 202021100079 U1 * 3/2021 ..... E04B 1/2403
(Continued)

OTHER PUBLICATIONS

International Search Report for International Application No. PCT/KR2021/007610, "Self-Building Kit System," dated Oct. 5, 2021.
(Continued)

*Primary Examiner* — Christine T Cajilig
(74) *Attorney, Agent, or Firm* — Hamilton, Brook, Smith & Reynolds, P.C.

(57) ABSTRACT

According to an example embodiment of the present disclosure, there is provided a self-building kit system including a first kit. The first kit includes: first modules of a first shape having two modules disposed opposite each other, and each including one or more first fitting portions cut out to a first length (d1) in the direction of the center thereof; and second modules of a second shape having N (N is a natural number) modules disposed between the two first modules, and each including one or more second fitting portions cut out to a second length (d2) in the direction of the center thereof. The second length (d2) is equal to or shorter than the first length (d1).

7 Claims, 10 Drawing Sheets

(56) References Cited

U.S. PATENT DOCUMENTS

| | | | | |
|---|---|---|---|---|
| 2012/0055101 | A1* | 3/2012 | Schooley | E04H 1/1205 52/79.9 |
| 2016/0032581 | A1* | 2/2016 | Sklar | E04C 3/122 52/220.8 |
| 2016/0348368 | A1* | 12/2016 | Godfrey | E04B 1/10 |
| 2019/0048574 | A1* | 2/2019 | Ernst | E04B 1/388 |
| 2023/0366195 | A1 | 11/2023 | Park | |

FOREIGN PATENT DOCUMENTS

| | | | | |
|---|---|---|---|---|
| GB | 2329649 | A * | 3/1999 | B65D 90/023 |
| JP | H07-081306 | B2 | 8/1995 | |
| JP | H11-001975 | A | 1/1999 | |
| JP | H111975 | A * | 1/1999 | |
| JP | 2009-091848 | A | 4/2009 | |
| JP | 2010-019073 | A | 1/2010 | |
| KR | 10-2002-0082987 | A | 11/2002 | |
| KR | 10-2009-0066377 | A | 6/2009 | |
| KR | 10-2010-0129043 | A | 12/2010 | |
| KR | 101583552 | B1 * | 1/2016 | |
| KR | 10-2017-0108771 | A | 9/2017 | |
| KR | 10-2019-0049096 | A | 5/2019 | |
| KR | 10-2242684 | B1 | 4/2021 | |
| KR | 10-2242685 | B1 | 4/2021 | |
| WO | WO-0036236 | A2 * | 6/2000 | C04B 38/0022 |
| WO | 2022/055084 | A1 | 3/2022 | |

OTHER PUBLICATIONS

International Search Report and Written Opinion received for PCT Patent Application No. PCT/KR2021/007611, mailed on Sep. 8, 2021, 16 pages (8 pages of English Translation and 8 pages of Original Document).

Notice of Allowance received for U.S. Appl. No. 18/246,661, mailed on May 28, 2025, 7 pages.

* cited by examiner

SELF-BUILDING KIT SYSTEM

TECHNICAL FIELD

The present disclosure relates to a self-building kit system. More particularly, the present disclosure relates to a self-building kit system that enables wood structure buildings to be constructed without variations in quality at economical costs.

BACKGROUND ART

In the construction of a building such as a house, a shopping mall, a building, or the like, various and complicated work processes including foundation work such as digging/earth retaining, framing work such as steel frame/reinforced concrete placement, floor/wall work, and finishing work are required after the design of a building designer. Most cases require experts having professional knowledge and experience because the cases are difficult for individuals lacking in expertise to handle on their own.

Meanwhile, although there are differences depending on the sizes of buildings to be completed, the construction of most buildings, more specifically the construction of a wood structure building, is not completed within a short period such as one day, two days, or the like. The possibility of completion within a set deadline is increased only when a large number of expert carpenters put in a lot of effort over a long period. Nevertheless, various reasons for construction delays occur during actual construction. There is a problem that there are many cases where the required labor cost far exceeds the initial budget.

Meanwhile, in the case of wood structure buildings using timber frames, there is a problem in that quality varies significantly depending on a carpenter in charge of construction because the level of completion depends a lot on the skill of the carpenter. In the case where the costs paid by customers are the same or similar, when the difference in quality between completed buildings is significant, the trust in a building contractor itself may decrease.

Therefore, there is a demand for a novel and innovative wood structure building construction system that enables rapid construction and reduces the proportion of highly-paid expert carpenters by implementing a low level of construction difficulty that allows non-experts to participate in construction in the construction of a wood structure building, and that also eliminates variations in quality attributable to the skills of constructors. The present disclosure relates to this.

DISCLOSURE OF INVENTION

Technical Goals

A technical problem to be solved by the present disclosure is to provide a self-building kit system that enables rapid construction and reduces the proportion of highly-paid expert carpenters by implementing a low level of construction difficulty that allows non-experts to participate in construction in the construction of a wood structure building.

Another technical problem to be solved by the present disclosure is to provide a self-building kit system that eliminates variations in quality attributable to the skills of constructors.

The technical problems of the present disclosure are not limited to the technical problems mentioned above, and other technical problems not mentioned will be clearly understood by those skilled in the art from the following description.

Technical Solutions

In order to solve the above technical problem, according to an example embodiment of the present disclosure, there is provided a self-building kit system including a first kit. The first kit includes: first modules of a first shape having two modules disposed opposite each other, and each including one or more first fitting portions cut out to a first length (d1) in the direction of the center thereof; and second modules of a second shape having N (N is a natural number) modules disposed between the two first modules, and each including one or more second fitting portions cut out to a second length (d2) in the direction of the center thereof. The second length (d2) is equal to or shorter than the first length (d1).

According to an example embodiment, the self-building kit system further may include a second kit. The second kit may include: third modules of a third shape having two modules disposed opposite each other, and each including one or more third fitting portions cut out to a third length (d3) in the direction of the center thereof and fourth modules of a fourth shape having N (N is a natural number) modules disposed between the two third modules, and each including one or more fourth fitting portions cut out to a fourth length (d4) in the direction of the center thereof. The fourth length (d4) may be equal to or shorter than the third length (d3).

According to an example embodiment, the first fitting portions included in each of the two first modules and the second fitting portions included in each of the two second modules may be fitted into the third fitting portions included in each of the two third modules and the fourth fitting portions included in each of the two fourth modules, respectively, at an angle of 90°.

According to an example embodiment, the sum of the thicknesses of the two first modules and the N second modules may be equal to the sum of the thicknesses of the two third modules and the N fourth modules.

According to an example embodiment, each of the two first modules may include one or more first holes disposed in predetermined areas; and, when the two first kits are fitted into both sides of the second kit with the second kit interposed therebetween, the two or more first holes included in one first kit and the two or more first holes included in the remaining one first kit may be disposed adjacent to each other.

According to an example embodiment, the first shape may be different from the second shape; the self-building kit system may further include a fifth module configured to be fitted into a space between the two or more first holes included in the one first kit and a space between the two or more first holes included in the remaining one first kit in an empty space formed between the two first modules due to the difference between the first shape and the second shape; and the fifth module may include two or more second holes disposed in predetermined areas.

According to an example embodiment, the self-building kit system may further include: a sixth module configured to be inserted into both the first hole selected from the two or more first holes included in the one first kit and disposed in the direction of a first surface and the first hole selected from the two or more first holes included in the remaining one first kit and disposed in the direction of the first surface; and a seventh module configured to be inserted into both the first hole selected from the two or more first holes included in the one first kit and disposed in the direction of a second surface and the first hole selected from the two or more first holes included in the remaining one first kit and disposed in the direction of the second surface.

According to an example embodiment, the sixth module may be inserted into an area along a direction in which the remaining one first kit is disposed within the first hole selected from the two or more first holes included in the one first kit and disposed in the direction of the first surface and an area along the direction in which the one first kit is disposed within the first hole selected from the two or more first holes included in the remaining one first kit and disposed in the direction of the first surface; and the seventh module may be inserted into an area along a direction opposite to the direction in which the remaining one first kit is disposed within the first hole selected from the two or more first holes included in one first kit and disposed in the direction of the second surface and an area along a direction opposite to the direction in which the one first kit is disposed within the first hole selected from the two or more first holes included in the remaining one first kit and disposed in the direction of the second surface.

According to an example embodiment, the first shape may be different from the second shape; the self-building kit system may further include an eighth module of an eighth shape configured to be partially fitted into a space between the two or more first holes included in the one first kit and a space between the two or more first holes included in the remaining one first kit in an empty space formed between the two first modules due to the difference between the first shape and the second shape; and the eighth module includes two or more third holes disposed in a portion of the eighth module to be inserted; and one or more first protrusions disposed on the outer peripheral surfaces of the eighth module.

According to an example embodiment, the self-building kit system may further include a ninth module of a ninth shape, including one or more fourth holes configured such that the first protrusions are inserted thereinto and one or more fifth fitting portions cut out to a fifth length (d5) in the direction of the center thereof; the eighth module and the ninth module are disposed at an angle of 90°; and the two first modules and the N second modules may be fitted into the fifth fitting portions.

According to an example embodiment, the self-building kit system may further include any one or more of: a tenth module of a tenth shape, including one or more third protrusions disposed on outer peripheral surfaces thereof, and one or more fourth protrusions disposed on the outer peripheral surfaces thereof; and an 11th module of an 11th shape, including one or more fifth protrusions disposed on outer peripheral surfaces thereof, one or more sixth protrusions disposed on the outer peripheral surfaces thereof; and one or more sixth fitting portions cut out to a sixth length (d6) in the direction of the center thereof.

According to an example embodiment, each of the two first modules may include one or more second protrusions disposed on outer peripheral surfaces thereof; and the self-building kit system further comprises a 12th module of a 12th shape including one or more six holes configured such that the one or more second protrusions are fitted thereinto.

Effects

According to the present disclosure described above, a wood structure building may be completed through simple construction such as the fitting or insertion of various modules into or over each other. The present disclosure has the effects of enabling rapid construction and reducing the proportion of highly-paid expert carpenters by implementing a low level of construction difficulty that allows non-experts to participate in construction in the construction of a wood structure building.

Furthermore, the present disclosure has the effect of eliminating the possibility that a variation in quality attributable to the skill of a constructor occurs because it is sufficient if various modules are fitted or inserted according to a design drawing of a wood structure building to be completed.

The effects of the present disclosure are not limited to the effects mentioned above, and other effects not mentioned will be clearly understood by those skilled in the art from the following description.

BEST MODE FOR CARRYING OUT THE INVENTION

Figure 1:
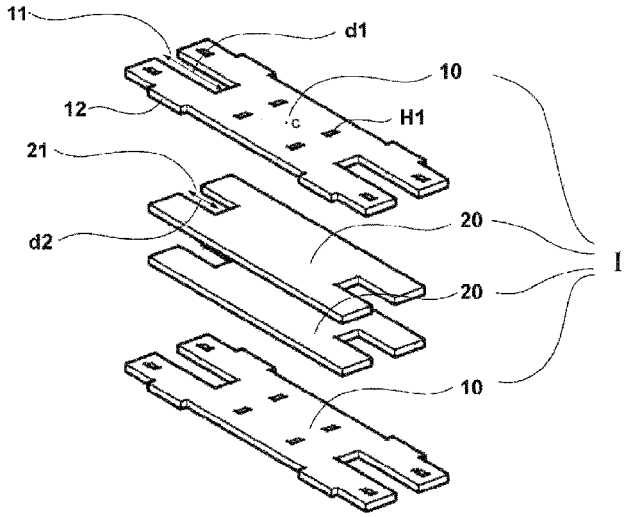
FIG. 1 is a perspective view of a first kit included in a self-building kit system according to an example embodiment of the present disclosure.

Hereinafter, preferred example embodiments of the present disclosure will be described in detail with reference to the accompanying drawings. Advantages and features of the present disclosure and methods for achieving them will be clearly understood by referring to the example embodiments to be described below in detail in conjunction with the accompanying drawings. However, the present disclosure is not limited to the example embodiments to be disclosed below, and may be implemented in a variety of different forms. These example embodiments are provided merely to complete the disclosure of the present invention and to fully inform those skilled in the art, to which the present disclosure pertains, of the scope of the invention. The present disclosure is only defined by the scope of the claims. Like reference numerals designate like components throughout the specification.

Unless otherwise defined, all terms (including technical and scientific terms) used herein may be used in meanings commonly understood by those of ordinary skill in the art to which the present disclosure pertains. In addition, terms defined in commonly used dictionaries are not interpreted as being ideal or excessively formal unless specifically defined explicitly. Terms used herein are intended to describe example embodiments but are not intended to limit the present disclosure. In this specification, singular forms also include plural forms unless specifically stated otherwise in a passage.

As used herein, the terms "comprises" and/or "comprising" mean that a stated component, step, operation, and/or component do not exclude the presence or addition of one or more other components, steps, operations, and/or components.

FIG. 1 is a perspective view of a first kit I included in a self-building kit system 1000 according to an example embodiment of the present disclosure.

The first kit I included in the self-building kit system 1000 according to the example embodiment of the present disclosure may include first modules 10 and second modules 20.

The first modules 10 have two modules disposed opposite each other, and each include one or more first fitting portions 11 cut out to a first length d1 in the direction of the center C thereof. The shape of the first modules 10 is a first shape.

Referring to FIG. 1, it may be seen that, based on the two second modules 20, one first module 10 is disposed over one second module 20 and another first module 10 is disposed under another second module 20. The first modules 10 are disposed over and under N (N is a natural number) second modules 20 (in the case where the modules are laid down), or in front of and behind N (N is a natural number) second modules 20 (in the case where the modules are placed upright), so that two second modules 20 may be required. Since the two first modules 10 are the same as each other, any one of them may be disposed over or under the second modules 20, or in front of or behind the second modules 20.

Meanwhile, each of the first modules 10 includes the one or more first fitting portions 11 cut out to the first length d1 in the direction of the center C thereof. In this case, each of the first fitting portions 11 is configured to serve to be fitted over a second kit II to be described later. Although it is sufficient if the first module 10 includes a single first fitting portion, it is desirable to include as many first fitting portions 11 as possible in order to improve the utilization of the first module 10, which is a basic framework in the self-building kit system 1000 according to the example embodiment of the present disclosure. In FIG. 1, a case where the first module 10 includes two first fitting portions 11 is shown by way of example.

The first length d1 is not defined specifically. However, it will be sufficient if the first length d1 is shorter than the distance from one end or the other end of the first module 10 to the center C thereof, i.e., half of the length of the first module 10, and is also equal to or longer than a second length d2, which is the length of second fitting portions 21 included in the two modules 20 to be described later.

The shape of the first module 10 is the first shape. There is no restriction on the specific type of first shape, but the first shape will generally be a polygon. The first module 10 includes the first fitting portions 11 but separate components are not combined into the first module, so that it may be seen that the first module 10 is implemented to include the first fitting portions 11 due to the first shape itself.

Meanwhile, referring to FIG. 1, it may be seen that the first shape includes four slight protrusions disposed on the outer peripheral surfaces thereof in addition to the first fitting portions 11. These portions are second protrusions 12, and the first module 10 is implemented to include the second protrusions 12 due to the first shape itself other than the combination of separate components, as in the case of the first fitting portions 11. That is, the first module 10 may include one or more second protrusions 12 disposed on the outer peripheral surfaces thereof, which will be described later.

Referring back to FIG. 1, it may be seen that each of the two first modules 10 includes one or more first holes H1 disposed in predetermined areas. In FIG. 1, eight first holes H1 are shown by way of example. In this case, each of the first holes H1 is not limited to a circular shape even though its name is a hole. As long as a portion penetrates the upper and lower surfaces of the first module 10, it may be considered the first hole H1 regardless of its shape. Other components may be inserted into the first holes H1, which will be described later.

The second modules 20 have N modules disposed between the two first modules 10, and each include one or more second fitting portions 21 cut out to a second length d2 in the direction of the center C thereof. The shape of the second module 20 is a second shape.

Since N is a natural number, the number of second modules 20 is sufficient if it is equal to or larger than 1. In the case where N is 1, when the thickness of each module is not increased, the overall thickness of the first kit I may tend to be excessively thin. In terms of the purpose of the present disclosure to construct a wood structure building, it may be preferable that N be 2 or more. In FIG. 1, a case where N is 2 is shown by way of example.

A description that is the same as the description of the first fitting portions 21 and the first shape is applied to the second fitting portions 21, except that the second fitting portions 21 are cut out to a second length d2 other than the first length d1 in the direction of the center C thereof and the second length d2 is equal to or shorter than the first length d1.

Figure 2:
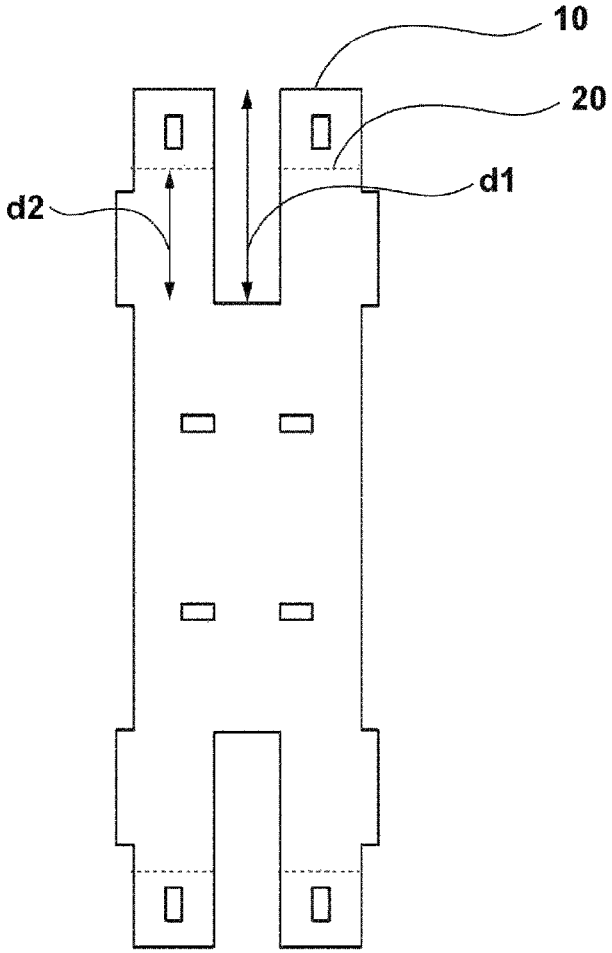
FIG. 2 is a top view of a state in which first modules and second modules are stacked one on top of another.

That is, the fitting portions included in the modules disposed inside is slightly less cut out in the direction of the center C than the fitting portions included in the modules disposed outside. Referring to FIG. 2, which is a top view of a state in which the first modules 10 (indicated by solid lines) and the second modules 20 (indicated by dotted lines) are stacked one on top of another, in a state in which the centers C of the first modules 10 and the second modules 20 are disposed at the same point, the second length d2 is equal to or shorter than the first length d1. Accordingly, it may be seen that the second fitting portions 21 are less cut out in the direction of the center C than the first fitting portions 11. When the N second modules 20 are disposed between the two first modules 10, a separate empty space is formed due to the difference between the first length d1 and the second length d2, and another component may be inserted into the corresponding space. Although this may be more clearly confirmed by reviewing a front view, a detailed description thereof will be given later.

Meanwhile, the second shape needs to be a shape included inside the first shape. In order for the second shape to be a shape included inside the first shape, it may be considered that in most cases, the two shapes are similar to each other. This may be confirmed by referring to FIG. 2. The shape of the first modules 10 is a shape formed by the outer peripheral surfaces of a rectangle in the direction of the center C and four rectangles disposed at respective apexes of the former rectangle, except for the difference in the partial shape due to the difference between the lengths of the first fitting portions 11 and the second fitting portions 21, the difference in the partial shape due to the non-inclusion of the first holes H1, and the difference in the partial shape due to the non-inclusion of the second protrusions 12. The shape of the second modules 20 is also formed by the outer peripheral surfaces of a rectangle in the direction of the center C and four rectangles disposed at respective apexes of the former rectangle, and may be considered to be similar to the first modules 10.

The second module 20 includes neither one or more holes disposed in predetermined areas nor one or more protrusions disposed on the outer peripheral surfaces thereof unlike the first module 10, and these are not essential. The second module 20 may also include one or more holes disposed in predetermined areas and one or more protrusions disposed on the outer peripheral surface thereof. However, forming one or more holes in the second module 20 or implementing the second shape to include one or more protrusions is also a factor that affects an increase in manufacturing cost of the second module 20, and the functions of the holes and the protrusions may be achieved sufficiently by each of the two first modules 10 disposed with the second modules 20 interposed therebetween including one or more holes and one or more protrusions. Therefore, it may be preferable that the second module 20 does not include them.

Figure 3:
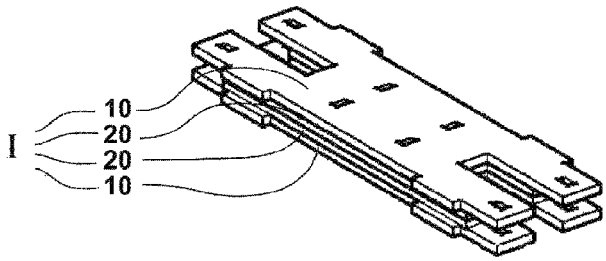
FIG. 3 is a perspective view of a first kit in which two first modules are disposed and two second modules are disposed between these first modules.

The first kit I included in the self-building kit system 1000 according to the example embodiment of the present disclosure has been described so far, and a perspective view of the first kit I in which the two first modules 10 are disposed and the two second modules 20 are disposed between the two first modules 10 is shown in FIG. 3. Although the first kit I has been described with reference to FIGS. 1 to 3, any set including two or more of the modules to be described below may be considered a kit. What is important is that a configuration in which two identical modules are disposed opposite each other, another type of N modules having a similar shape are disposed between the two identical modules and there is a difference between the lengths of the fitting portions thereof may be viewed as a kit. This is applied equally to the second kit II, which will be described below.

The self-building kit system 1000 according to the example embodiment of the present disclosure further includes a second kit II. The second kit II includes: third modules 30 of a third shape having two modules disposed opposite each other and each including one or more third fitting portions 11 cut out to a third length d3 in the direction of the center thereof; and fourth modules 40 of a fourth shape having N modules disposed between the two third modules and including one or more fourth fitting portions 41 cut out to a fourth length d4 in the direction of the center thereof. The length d4 may be equal to or shorter than the third length d3.

Figure 4:
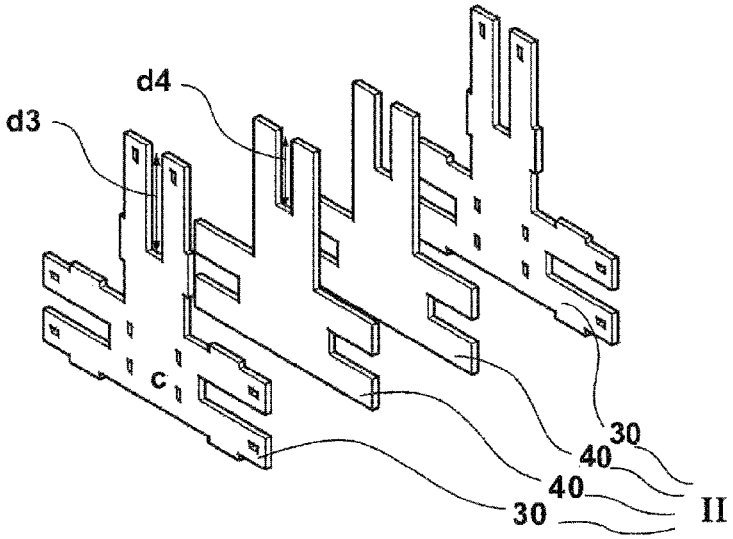
FIG. 4 is a perspective view of a second kit included in the self-building kit system according to the example embodiment of the present disclosure.

FIG. 4 is a perspective view of the second kit II included in the self-building kit system 1000 according to the example embodiment of the present disclosure.

The second kit II included in the self-building kit system 1000 according to the example embodiment of the present disclosure may include the third modules 30 and the fourth modules 40.

In this case, the third modules 30 may be considered to correspond to the first modules 10 included in the first kit I, and the fourth modules 30 may be considered to correspond to the second modules 20. Since the same descriptions may be applied accordingly, detailed descriptions will be omitted to prevent redundancy.

Meanwhile, a representative difference is a difference in the shape. The third modules 30 have the third shape, and the fourth modules 40 have the fourth shape. The third shape and the fourth shape are different from the first shape of the first module 10 and the second shape of the second module 20, respectively, but are similar to each other like the first shape and the second shape.

In addition, the third length d3 and the fourth length d4 may also be viewed as a difference. The first fitting portions 11 included in the first modules 10 are cut out to the first length d1 in the direction of the center C thereof, whereas the third fitting portions 31 included in the third modules 30 are cut out to the third length d3 in the direction of the center C thereof. The second fitting portions 21 included in the second modules 20 are cut out to the second length d2 in the direction of the center C thereof, whereas the fourth fitting portions 41 included in the fourth modules 40 are cut out to the fourth length d4 in the direction of the center C. As in the relationship between the second length d2 and the first length d1, the fourth length d4 is equal to or shorter than the third length d3.

In this case, as for the relationship between the first length d1 and the third length d3 and the relationship between the second length d2 and the fourth length d4, they are not particular relationships. The first length d1 and the third length d3 may be the same as or different from each other, and the second length d2 and the fourth length d4 may be the same as or different from each other. When the first length d1 and the third length d3 are the same as each other and the second length d2 and the fourth length d4 are the same as each other, one end of one first kit I and one end of the other first kit I disposed opposite each other in a state in which the two first kits I are fitted into both sides of the second kit II to be described later with the second kit II interposed therebetween come into contact with each other and there is no gap therebetween. When the first length d1 and the third length d3 are different from each other and the second length d2 and the fourth length d4 are different from each other, for example, the third length d3 is longer than the first length d1 and the fourth length d4 is longer than the second length d2, one end of one first kit I and one end of the other first kit I disposed opposite each other in a state in which the two first kits I are fitted into both sides of the second kit II to be described later with the second kit II interposed therebetween do not come into contact with each other and there is a gap corresponding to the difference in the length.

Figure 5:
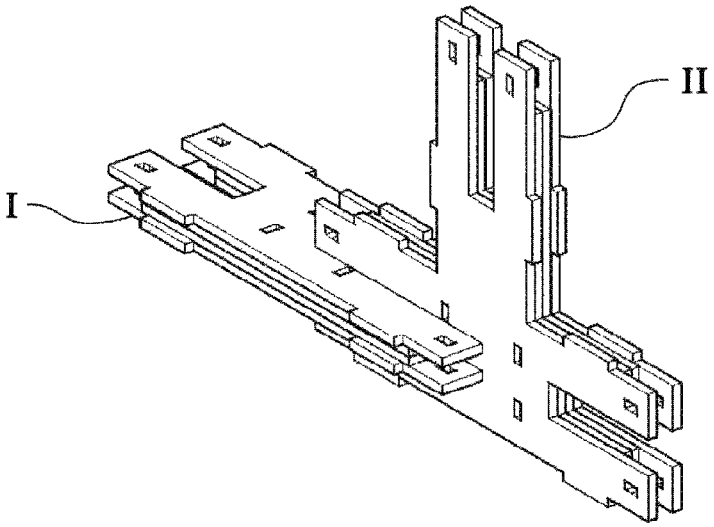
FIG. 5 is a perspective view showing a state in which the first kit and the second kit are fitted into each other.

FIG. 5 is a perspective view showing a state in which the first kit I and the second kit II are fitted into each other. More specifically, FIG. 5 is a perspective view showing a state in which first fitting portions 11 included in two first modules 10 and second fitting portions 21 included in two second modules 20 are fitted into third fitting portions 31 included in two third modules 30 and fourth fitting portions 41 included in two fourth modules 40, respectively. Referring to this drawing, it may be seen that the first kit I and the second kit II, more specifically the first fitting portions 11 included in the two first modules 10 and the second fitting portions 21 included in the two second modules 20, and the third fitting portions 31 included in the two third modules 30 and the fourth fitting portions 41 included in the two fourth modules 40, are fitted into each other at an angle of 90° when they are fitted into each other.

In this case, the sum of the thicknesses of the first kit I, which is the sum of the thicknesses of the two first modules 10 and N (two in the case of FIG. 5) second modules 20, and the sum of the thicknesses of the second kit II, which is the sum of the thicknesses of the two third modules 30 and N (two in the case of FIG. 5) fourth modules 40, are made to be the same as each other. Accordingly, strong fixing power may be obtained simply by the first kit I and the second kit II being fitted into each other without using a separate fixing or adhesive means. Therefore, the manufacturing cost may be reduced, and a non-expert may participate in construction through the implementation of a low level of construction difficulty.

Meanwhile, the fact that the sum of the thicknesses of the first kit I, which is the sum of the thicknesses of the two first modules 10 and the two second modules 20, and the sum of the thicknesses of the second kit II, which is the sum of the thicknesses of the two third modules 30 and the two fourth modules 40, are the same as each other means that the first modules 10 and the third modules 30 have the same thickness and the second modules 20 and the fourth modules 40 have the same thickness. If the thickness of the first modules 10 and the thickness of the second module 20 are implemented to be the same as each other in order to implement a low level of construction difficulty, all the first modules 10 to the fourth modules 40 have the same thickness.

Hereinafter, a state in which two first kits I are fitted into both sides of a second kit II with the second kit II interposed therebetween, the description of which was withheld above, and other modules included in the self-building kit system 1000 according to the example embodiment of the present disclosure used in the corresponding state will be described.

Figure 6:
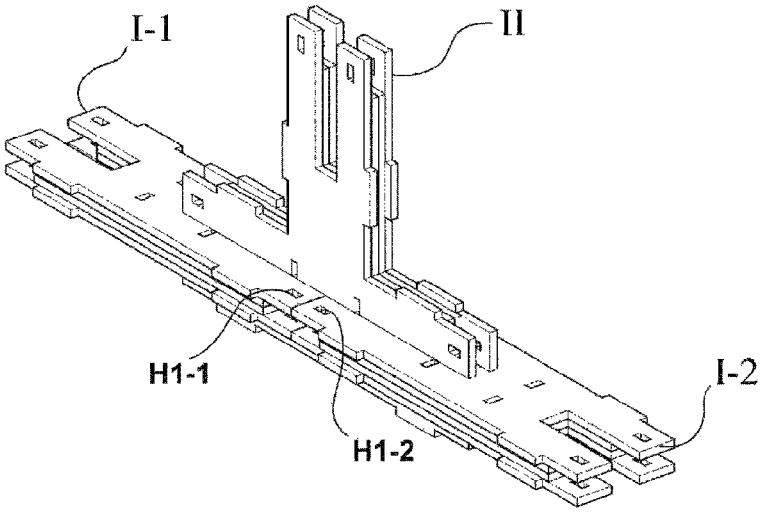
FIG. 6 is a perspective view showing a state in which two first kits are fitted into both sides of a second kit with the second kit interposed therebetween.

FIG. 6 is a perspective view showing a state in which two first kits I are fitted into both sides of a second kit II with the second kit II interposed therebetween.

Referring to FIG. 6, when the two first kits I are fitted into both sides of the second kit II with the second kit II interposed therebetween, two or more first holes H1-1 included in one first kit I-1 and two or more first holes H1-2 included in the remaining one first kit I-2 are disposed adjacent to each other.

This corresponds to a case where the first holes H1 are disposed on both sides with the first fitting portion 21 interposed therebetween. A sixth module 60 and a seventh module 70 are inserted into the above holes and second holes H2 disposed in a fifth module 50 to be described below. This will be described below.

Figure 7:
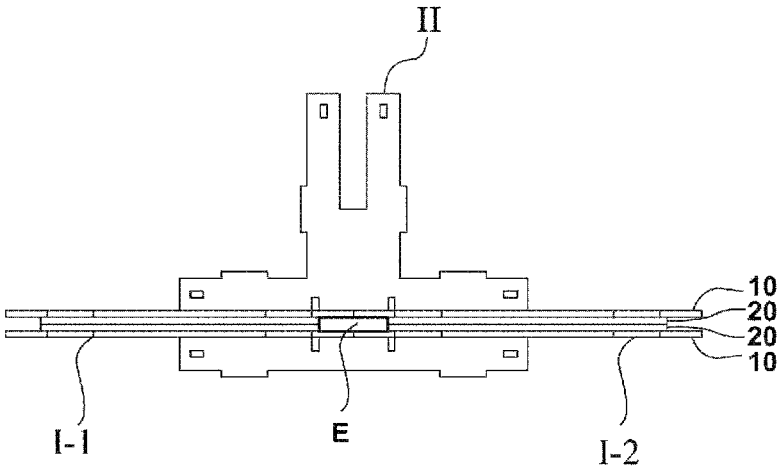
FIG. 7 is a front view of FIG. 6.

In the foregoing description of the first kit I, due to the difference between the first length d1 to which the first fitting portions 11 are cut out and the second length d2 to which the second fitting portions 21 are cut out, when N second modules 20 are arranged between two first modules 10, a separate empty space is formed, and thus another component may be inserted into the corresponding space. This has been described as being more clearly confirmed by reviewing a front view. In FIG. 7, there is shown a front view of FIG. 6.

Referring to FIG. 7, it may be seen that an empty space E is formed between the two first modules 10 due to the difference between the first length d1 and the second length d2, which is applies to both of the two first kits I in the same manner.

Meanwhile, it has been stated above that, when the first length d1 and the third length d3 are the same as each other and the second length d2 and the fourth length d4 are the same as each other, one end of one first kit I and one end of the other first kit I disposed opposite each other in a state in which the two first kits I are fitted into both sides of the second kit II with the second kit II interposed therebetween come into contact with each other and there is no gap therebetween. The state shown in FIG. 7 may be viewed as the above state. The overall empty space E is formed by combining a space E1, which is a space inside one first kit I-1, more specifically a space between two or more first holes H1-1, and a space E2, which is a space inside the remaining one first kit I-2, more specifically a space between two or more first holes H1-2.

A module inserted into the empty space E is the fifth module 50. That is, the fifth module 50 is inserted into the space E1 between the two or more first holes H1-1 included in the one first kit I-1 and the space E2 between the two or more first holes H1-2 included in the remaining one first kit I-2 in the empty space formed between the two first modules due to the difference between the first shape of the first modules 10 and the second shape of the second modules 20. The fifth module 50 may further include two or more second holes H2 disposed in predetermined areas.

Since this fifth module 50 is inserted into the empty space E formed between the two first modules, the thickness thereof is equal to the thickness of the N second modules 20 disposed between the two first modules 10. As shown in FIG. 7, when N is 2, the thickness of the fifth module 50 is equal to the thickness of the two second modules 20.

In this case, the fifth module 50 may be implemented as one component having the same thickness as the N second modules 20. In some cases, it may be implemented in a form in which several layers, such as a 5-1 module 50-1 to a 5-N module 50-N, are stacked and disposed. In this case, each of the 5-1 module 50-1 to the 5-N module 50-N includes second holes H2 disposed in predetermined areas.

Figure 8:
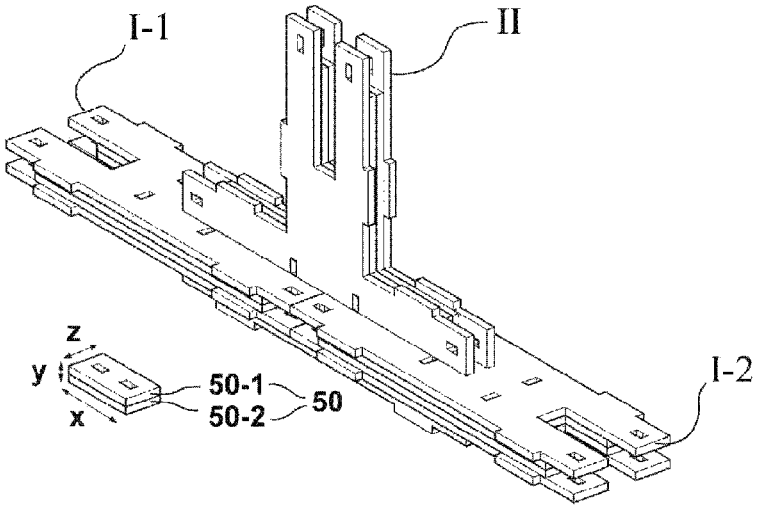
FIG. 8 is a perspective view showing a state in which a fifth module is fitted in FIG. 6.

FIG. 8 is a perspective view showing a state in which the fifth module 50 is fitted in FIG. 6. It may be confirmed that since N is 2, the fifth module 50 includes two layers, i.e., the 5-1 module 50-1 and the 5-2 module 50-2. It may be confirmed that the total thickness x of the 5-1 module 50-1 and the 5-2 module 50-2 is the same as that of the two second modules 20.

Meanwhile, it may be preferable that the horizontal length y of the fifth module 50 be implemented as 2(d1−d2), which is (d1−d2)+(d1−d2), because the empty space E into which the fifth module 50 is inserted is formed due to the difference between the first length d1 of the first fitting portions 11 and the second length d2 of the second fitting portions 21 as described above and the fifth module 50 is inserted into the empty space E including the space E1 between the two or more first holes H1-1 included in one first kit I-1 and the space E2 between the two or more first holes H1-2 included in the remaining one first kit I-2. Accordingly, strong fixing power may be obtained simply by insertion into the empty space E without using a separate fixing or adhesive means. Therefore, the manufacturing cost may be reduced, and a non-expert may participate in construction through the implementation of a low level of construction difficulty.

The width z of the fifth module 50 may preferably be implemented as a length that prevents the fifth module 50 from protruding outward when the fifth module 50 is inserted, more specifically about half of a length obtained by excluding the first fitting portion 11 from the width of the first module 10 in a state excluding the second protrusions 12 because the second kit II is disposed in the innermost portion of the empty space E.

Meanwhile, apart from the fact that the fifth module 50 is inserted into the empty space E and thus strong fixation force is obtained, there is no problem no matter how much the fixation force between modules is further strengthened because the self-building kit system 1000 according to the example embodiment of the present disclosure is proposed for constructing a wood structure building. Components for this are the sixth module 60 and the seventh module 70.

The fifth module 50 is inserted into the empty space E, and can exert strong fixation force by adjusting the thickness x, length y, and width z thereof. Since the fifth module 50 is not formed in an integrated manner, there is no guarantee that the inserted fifth module 50 will not be separated. In this case, the inserted fifth module 50 may be firmly fixed in order not to be separated through the sixth module 60 and the seventh module 70 that are inserted into the first holes H1 included in the first module 10 and the second holes H2 included in the fifth module 50.

Figure 9:
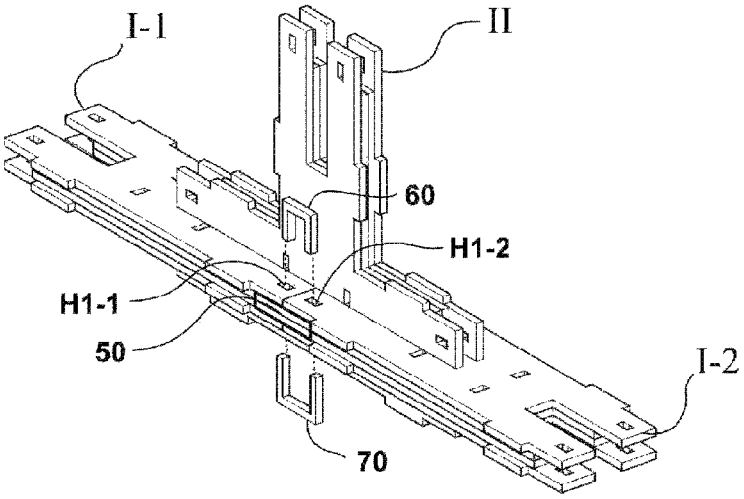
FIG. 9 is a perspective view showing a state in which a sixth module and a seventh module are inserted in FIG. 8.
Figure 10:
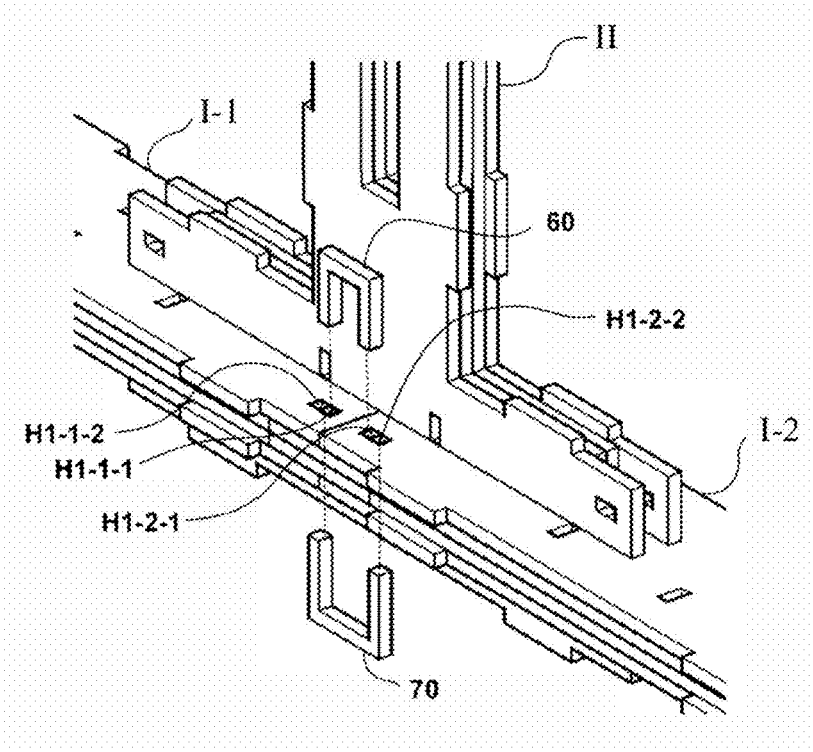
FIG. 10 is an enlarged perspective view showing the insertion of the sixth module and the seventh module into first holes in a state in which other components are removed.

FIG. 9 is a perspective view showing a state in which the sixth module 60 and the seventh module 70 are inserted in FIG. 8 in a state in which the fifth module 50 has been inserted. FIG. 10 is an enlarged view of FIG. 8. It may be seen that, based on the fifth module 50, the sixth module 60 is inserted from above and the seventh module 70 is inserted from below. Other components, the description of which was withheld and which are inserted into the first holes H1, are the sixth module 60 and the seventh module 70.

More specifically, the sixth module 60 is inserted into both a first hole H1-1-1 selected from the two or more first holes H1-1 included in one first kit I-1 and disposed in the direction of a first surface and a first hole H1-2-1 selected from the two or more first holes H1-2 included in the remaining one first kit I-2 and disposed in the direction of the first surface. The seventh module 70 is inserted into both a first hole H1-1-2 selected from the two or more first holes H1-1 included in one first kit I-1 and disposed in the direction of a second surface and a first holes H1-2-2 selected from the two or more first holes H1-2 included in the remaining one first kit I-2 and disposed in the direction of the second surface. In this case, the direction of the first surface is the direction of one of the two first modules 10 the top surface of which is exposed, and the direction of the second surface is the direction of one of the two first modules 10 the bottom surface of which is exposed.

The inserted sixth module 60 is inserted into the second holes H2 included in the fifth module 50, and the inserted seventh module 70 is also inserted into the second holes H2 included in the fifth module 50. Since the sixth module 60 is inserted from above and also the seventh module 70 is inserted from below with the fifth module 50 disposed therebetween, fixation may be performed in two stages.

Meanwhile, referring to FIG. 10, it may be seen that the sixth module 60 is implemented in a sideways U shape and portions corresponding to the legs thereof are inserted into both the first hole H1-1-1 selected from the two or more first holes H1-1 included in one first kit I-1 and disposed in the direction of the first surface and the first hole H1-2-1 selected from the two or more first holes H1-2 included in the remaining one first kit I-2 and disposed in the direction of the first surface and are also inserted into the two second holes H2 included in the fifth module 50. It may also be seen that the seventh module 70 is implemented in a sideways U shape and portions corresponding to the legs thereof are inserted into both the first hole H1-1-2 selected from the two or more first holes H1-1 included in one first kit I-1 and disposed in the direction of the second surface and the first holes H1-2-2 selected from the two or more first holes H1-2 included in the remaining one first kit I-2 and disposed in the direction of the second surface and are also inserted into the two second holes H2 included in the fifth module 50. While the fifth module 50 includes two holes, the number of upper and lower portions corresponding to the legs is four in total (two legs of the sixth module, and two legs of the seventh module). Accordingly, it may be necessary to review the relationship in which the four portions are inserted into the two holes. This is also related to the strengthening of the fixation force. This will be described below.

In the foregoing description of the first holes H1, it has been stated that each of the first holes H1 is not limited to a circular shape even though its name is a hole and that, as long as a portion penetrates the upper and lower surfaces of the first module 10, it may be considered the first hole H1 regardless of its shape. When even insertion relationships with the sixth module 60 and the seventh module 70 are taken into consideration, the shape of the first holes H1 may be related to the shapes of the sixth module 60 and the seventh module 70. This is intended to strengthen the fixation force.

Accordingly, the sixth module 60, more specifically the two legs included in the sixth module 60, is inserted into an area H1-1-1-*p* along the direction in which the remaining one first kit I-2 is disposed within the first hole H1-1-1 selected from the two or more first holes H1-1 included in one first kit I-1 and disposed in the direction of the first surface and an area H1-2-1-*p* along the direction in which the remaining one first kit I-2 is disposed within the first hole H1-2-1 selected from the two or more first holes H1-2 included in the remaining one first kit I-2 and disposed in the direction of the first surface. The seventh module 70, more specifically the two legs included in the seventh module 70, is inserted into an area H1-1-2-*q* along the direction opposite to the direction in which the remaining one first kit I-2 is disposed within the first hole H1-1-2 selected from the two or more first holes H1-1 included in one first kit I-1 and disposed in the direction of the second surface and an area H1-2-2-*q* along the direction opposite to the direction in which the remaining one first kit I-2 is disposed within the first hole H1-2-2 selected from the two or more first holes H1-2 included in the remaining one first kit I-2 and disposed in the direction of the second surface.

In plain words, in the case where the number of first holes are two in a state in which each of the first holes is divided into two areas, the total number of divided areas becomes four. The two legs included in the sixth module 60 are inserted into the inner two (located close to each other) of the four areas, and the two legs included in the seventh module 70 are inserted into the outer two (located far from each other) of the four areas. In order to strengthen the fixation force in an inserted state, no space needs to be left between the legs and the holes and the holes need to be full. Accordingly, the cross section of the two legs included in the sixth module 60, the cross section of the two legs included in the seventh module 70, and the cross section of the individual regions of the first holes H1 divided when each of the first holes H1 is divided into two regions need to be the same as each other. For example, in the case where the shape of the first hole H1-1, H1-2 is a rectangle with a width of 20 cm and a length of 6 cm, when the cross section of the two legs included in the sixth module 60 is a rectangle shape with a width of 10 cm and a length of 6 cm and the cross section of the two legs included in the seventh module 70 is also a rectangle shape with a width of 10 cm and a length of 6 cm, one of the two legs included in the sixth module 60 and one of the two legs included in the seventh module 70 may be inserted into one first hole H1-1, H1-2 in a full state.

So far, the state in which the two first kits I are inserted into both sides of the second kit II with the second kit II interposed therebetween and the fifth module 50, the sixth module 60, and the seventh module 70, which are other modules included in the self-building kit system 1000 according to the example embodiment of the present disclosure used in the corresponding state, have been described. These are components that are fitted or inserted into a forward part in front of the second kit II in FIGS. 8 and 9. Since they are perspective views, the same components are hidden by the second kit II, but may be fitted or inserted into a rearward part behind the second kit II.

Now, the eighth module 80, other than the fifth module 50, the sixth module 60 and the seventh module 70, which is another component that may be fitted or inserted into a part in front of or behind the second kit II, will be described.

Figure 11:
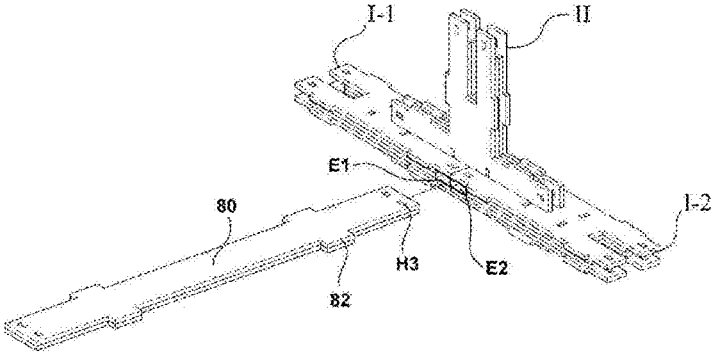
FIG. 11 is a perspective view showing a state in which an eighth module is fitted in FIG. 6.

FIG. 11 is a perspective view showing a state in which the eighth module 80 is fitted in FIG. 6. Although the eighth module 80 may be fitted into the upper part of the second kit II, it may be covered when illustrated in the drawing. Accordingly, for convenience of description, the eighth module 80 will be described based on a case where it is inserted into a part in front of the second kit II like the fifth module 50.

The eighth module 80 is inserted into a space E1 between two or more first holes H1-1 included in one first kit I-1 and a space E2 between the two or more first holes H1-2 included in the remaining one first kit I-2 in the empty space E that is formed between the two first modules 10 due to the difference between the first shape of the first modules 10 and the second shape of the second module 20. The eighth module 80 may include two or more third holes H3 disposed in the fitted portion thereof, and one or more first protrusions 82 disposed on the outer peripheral surfaces thereof.

Since the eighth module 80 is configured to fit into the empty space E like the fifth module 50, a description that is the same as that of the fifth module 50 is applied to the eighth module 80, and only differences therebetween will be described below.

Figure 12:
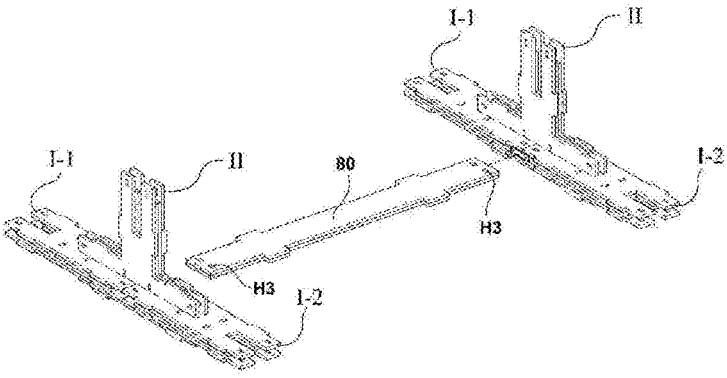
FIG. 12 is a perspective view showing a state in which the eighth module is fitted into and connects two structures in each of which a first kit is fitted into both sides of a second kit with the second kit disposed therebetween.

The overall fifth module 50 is fitted into the empty space E, whereas the eighth module 80 is partially fitted into the same empty space E. This means that the remaining portion exposed to the outside is present in a state in which the eighth module 80 is fitted into the empty space E. The end of the remaining portion exposed to the outside may be fitted into another structure in which two first kits I are fitted into both sides of a second kit II with the second kit II interposed therebetween. This is shown in FIG. 12. As a result, the eighth module 80 serves as a medium for connecting a structure in which two first kits I are fitted into both sides of a second kit II with the second kit II interposed therebetween and another structure in which two first kits I are fitted into both sides of a second kit II with the second kit II interposed therebetween.

Meanwhile, the two or more third holes H3 disposed in the fitted portion perform the same function as the two or more second holes H2 disposed in the predetermined areas of the fifth module 50. Accordingly, the sixth module 60 and the seventh module 70 may be inserted into the third holes H3 as well as the second holes H2 and strengthen the fixation force. However, since the same description is applied thereto, a detailed description thereof will be omitted in order to avoid redundancy.

Even when the structures in each of which two first kits I are fitted into both sides of a second kit II with the second kit II interposed therebetween are fitted over both ends of the eighth module 80 and the sixth module 60 and the seventh module 70 are inserted to strengthen the fixation force in an inserted state, there may be required an additional component configured to strengthen the eighth module 80 itself, which is thinner than the first kits I and the second kit II, and the coupling with the structures in each of which two first kits I are fitted into both sides of a second kit II with the second kit II interposed therebetween. This is related to ninth modules 90, which will be described below.

Each of the ninth modules 90 includes one or more fourth holes H4 configured such that the first protrusions 82 are inserted thereinto and one or more fifth fitting portions 91 cut out to a fifth length d5 in the direction of the center C thereof. A shape including the one or more fourth holes H4 and the one or more fifth fitting portions 91 is a ninth shape. Although one or more fifth holes H5 disposed in a predetermined area may be further included, this will be described later.

Figure 13:
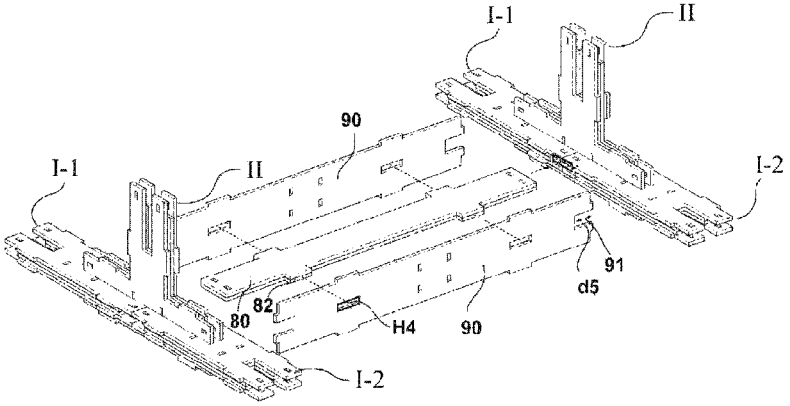
FIG. 13 is a perspective view showing a state in which ninth modules are fitted in FIG. 12.

FIG. 13 is a perspective view showing a state in which ninth modules 90 are fitted in FIG. 12. It may be preferable that the eighth module 80 includes first protrusions 82 on both side peripheral surfaces so that the two ninth modules 90 may be fitted into both sides of the eighth module 80.

More specifically, the first protrusions 82 included in the eighth module 80 are inserted into fourth holes H4 included in the ninth modules 90. It may be preferable that the fixation force be strengthened in an inserted state by making the shape of the first protrusions 82 and the shape of the fourth holes H4 identical to each other. In this case, the eighth module 80 and the ninth modules 90 are each disposed at an angle of 90°.

Meanwhile, referring to FIG. 13, it may be confirmed that each of the ninth modules 90 includes fifth fitting portions 91 at both ends thereof. The fifth fitting portions 91 serve to strengthen the fixation force between the ninth modules 90 and the two structures in each of which the two first kits I are fitted into both sides of the second kit II with the second kit II interposed therebetween. Through this, the fixation force may be strengthened in relation to the eighth module 80, the ninth modules 90, and all the structures in each of which the two first kits I are fitted into both sides of the second kit II with the second kit II interposed therebetween.

More specifically, the two first modules 10 and the N second modules 20 may be fitted into each of the fifth fitting portions 91, and the fifth fitting portions 91 serve to firmly hold the first kits I on the outsides of the first kits I.

Meanwhile, there is no particular restriction on the fifth length d5 of the fifth fitting portions 91. However, it may be preferable that the fifth length d5 of the fifth fitting portions 91 is implemented as about half of a length obtained by excluding the first fitting portion 11 from the width of the first module 10 in a state excluding the second protrusions 12, like the width z of the fifth modules 50 described above.

Figure 14:
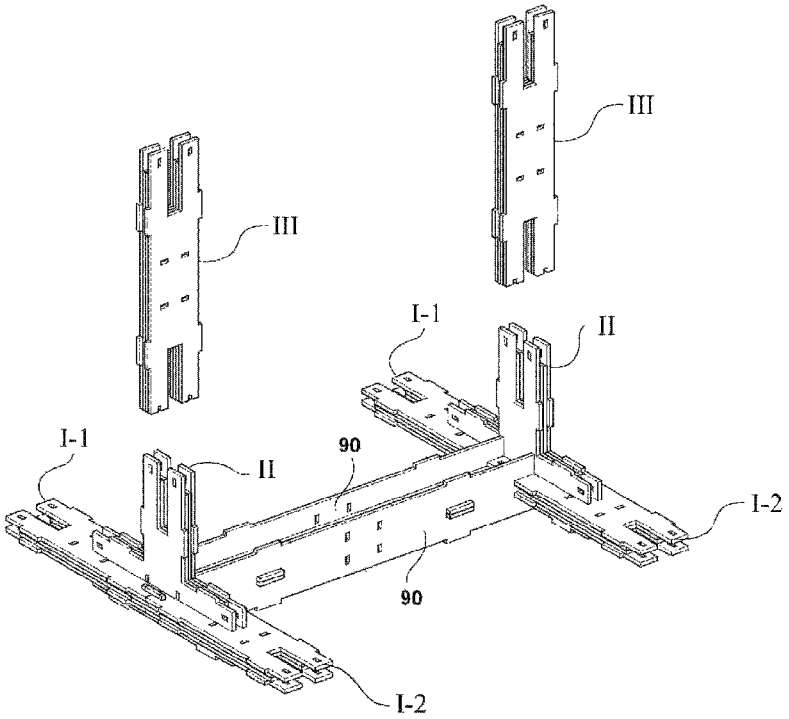
FIG. 14 is a perspective view showing a state in which additional kits are inserted in a state in which the ninth modules have been inserted in FIG. 13.

FIG. 14 is a perspective view showing a state in which additional kits III are inserted in a state in which the ninth modules 90 have been inserted in FIG. 13. Each of the additional kits III is fitted into the remaining one fitting portion of the second kit II in each of the structures in each of which the two first kits I are fitted into both sides of the second kit II with the second kit II interposed therebetween, more specifically the third fitting portion 31 and the fourth fitting portion 41, at an angle of 90°.

Meanwhile, each of the additional kits III seems to have the same shape as the first kit I shown in FIG. 1. However, when a closer look is taken at it, it may be seen that recesses P are disposed at the ends of both sides of the lower fitting portion. These are spaces that may accommodate portions of the top of the sixth module 60 to be disposed below in a state in which the additional kit III has been inserted. Although this is a description that will be applied to all modules constituting the additional kit III, there is no significant difference between the additional kit III and the first kit I except for this, so that separate reference numerals are not assigned to modules.

Figure 15:
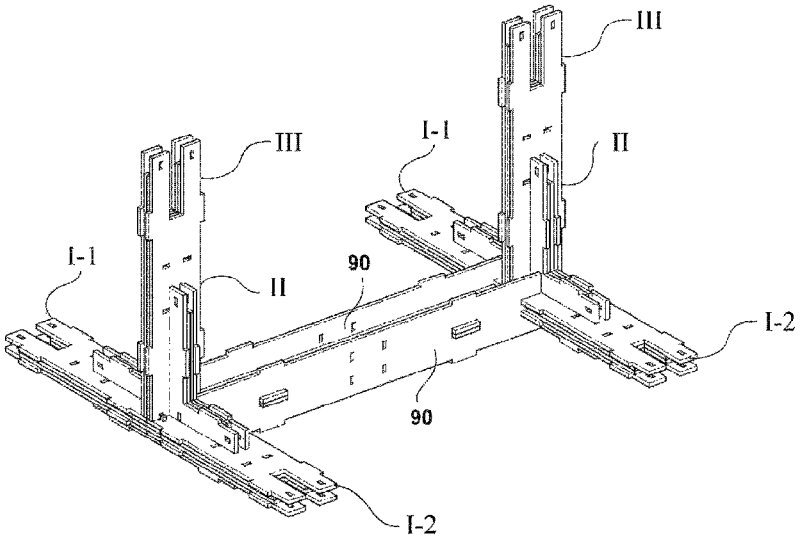
FIG. 15 is a perspective view of structure 1.

So far, the first modules 10 to the ninth modules 90 included in the self-building kit system 1000 according to the example embodiment of the present disclosure have been described. In FIG. 15, there is shown a perspective view of a structure in which all of the first modules 10 to the ninth modules 90 and the additional kits III including the modules to which separate reference numerals are not assigned are fitted into one another. When the structure illustrated in the perspective view shown in FIG. 15 is referred to as structure 1, there are required structure 2, which is another structure including the modules described above, and additional modules configured to connect structure 2 to structure 1 in order to expand structure 1 to in the lateral direction. This is related to tenth modules 100, which will be described below.

Figure 16:
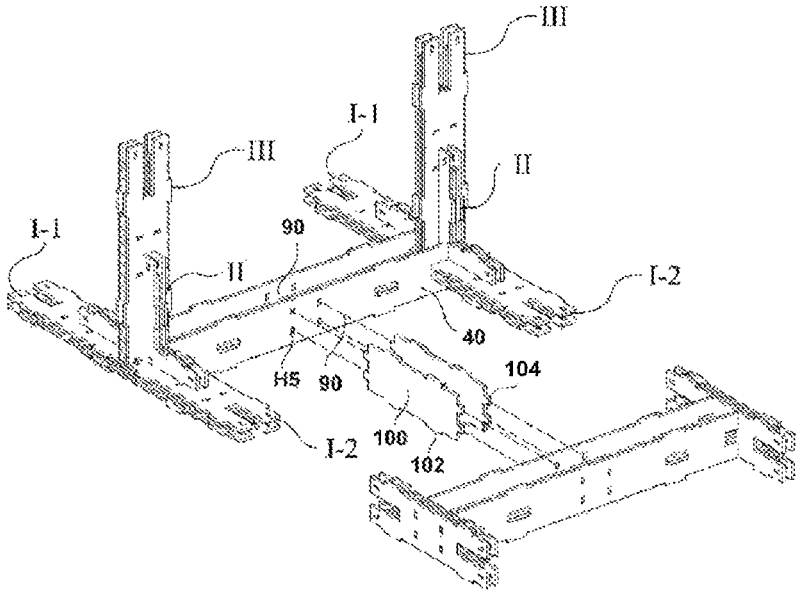
FIG. 16 is a perspective view showing a state in which tenth modules connect structure 1 and structure 2.

FIG. 16 is a perspective view showing a state in which the tenth modules 100 connect structure 1 and structure 2. Each of the tenth modules 100 has a tenth shape including one or more third protrusions 102 disposed on the outer peripheral surfaces thereof and one or more fourth protrusions 104 disposed on the outer peripheral surfaces thereof. The third protrusions 102 are disposed on the outer peripheral surfaces in the longitudinal direction, and the fourth protrusions 104 are disposed on the outer peripheral surfaces in the widthwise direction.

Figure 17:
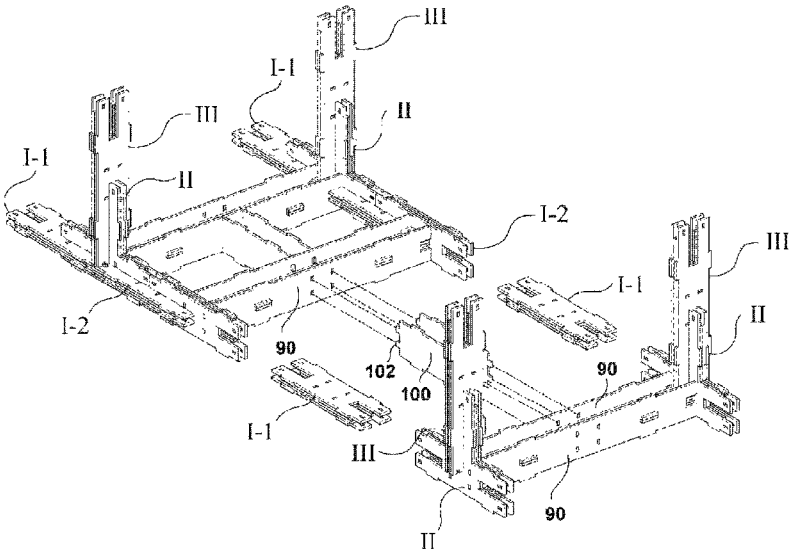
FIG. 17 is a perspective view showing a state in which a structure is expanded in length in the lateral direction.
Figure 18:
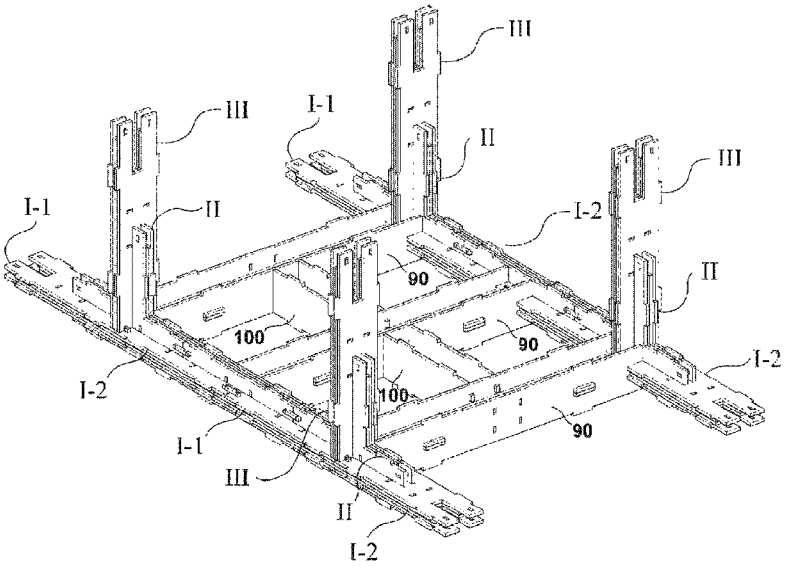
FIG. 18 is a perspective view of structure 3.

The fourth protrusions 104 may be inserted into the fifth holes H5 included in the ninth modules 90. Through this, structure 1 and structure 2 may be connected to each other in the lateral direction. Depending on the number of tenth modules 100 used, a structure may be successively expanded in length in the lateral direction, as shown in FIG. 17. A structure that has been completed up to the connection shown in FIG. 17 is shown in FIG. 18, and is named structure 3.

Now, the expansion of structure 3 in length in the vertical direction will be described.

In the foregoing description given with reference to FIG. 14, the fitting of the additional kits III may be viewed as the expansion in length in the vertical direction. First kits I may be fitted into the exposed fitting portions included in the additional kits III. In this way, the length in the vertical direction may be expanded.

Figure 19:
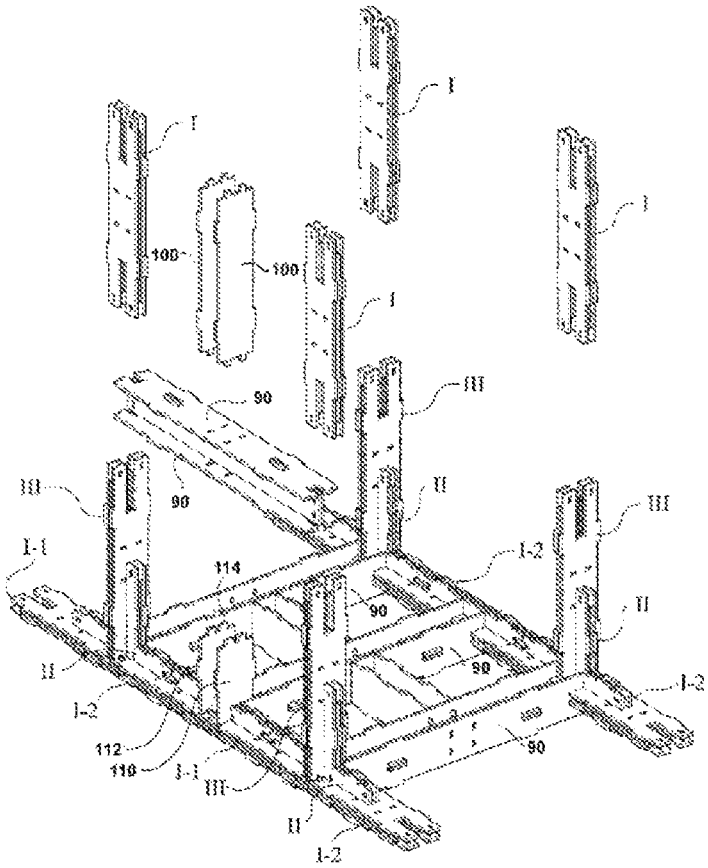
FIG. 19 is a perspective view showing a state in which a structure is expanded in length in the vertical direction.

Meanwhile, in the expansion in length in the vertical direction, there may be required 11th modules 110 of an 11th shape including one or more fifth protrusions 112 disposed on the outer peripheral surfaces thereof, one or more sixth protrusions 114 disposed on the outer peripheral surfaces thereof, and one or more sixth fitting parts 111 (not shown) each cut out to a sixth length d6 (not shown) in the direction of the center C thereof. A state in which first kits I, ninth modules 90, tenth modules 100, and 10'th module 100' and 11th module 110 having different lengths in the vertical direction are fitted into structure 3 is shown in FIG. 19.

Due to such tenth modules 100 and eleventh modules 110, a structure may be expanded in length in the lateral and vertical directions. The extent to which it may be expanded will depend on the design drawing of the designer of a wood structure building.

Figure 20:
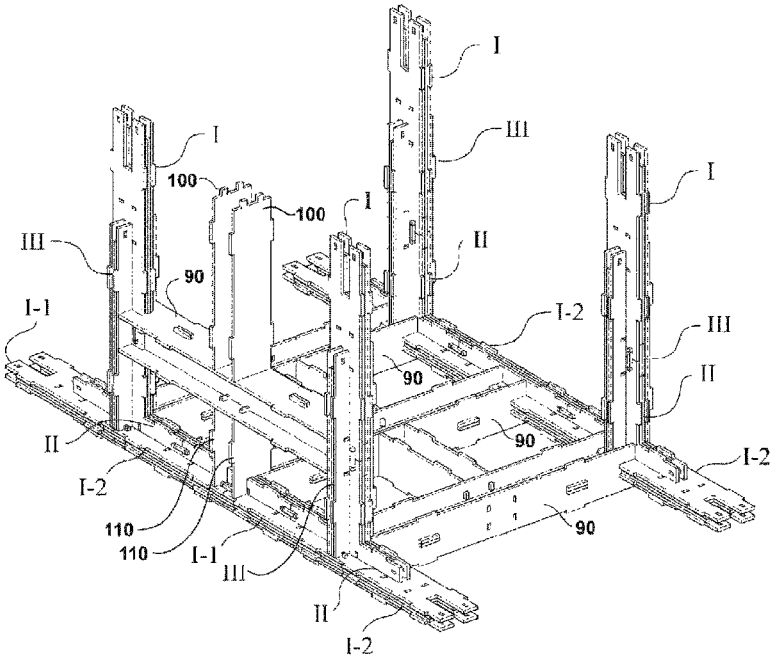
FIG. 20 is a perspective view of structure 4.

FIG. 20 shows a structure that has been expanded in length in the lateral and vertical directions according to a specific design drawing, which is named structure 4.

When construction has been constructed up to structure 4, it is necessary to fill the spaces between frames with surfaces because it is in a state of being similar to a timber frame to some extent. This is related to 12th modules 120.

Each of the 12th modules 120 includes one or more sixth holes H6 configured such that one or more second protrusions 12 may be fitted thereinto, and has a twelfth shape.

Unlike the other modules described so far, the 12th modules 120 serve only as surfaces, so that they do not require separate fitting portions or protrusions. It is sufficient if they each include only the sixth holes H6 and are fitted over second protrusions 12.

Meanwhile, the twelfth shapes of the twelfth modules 120 is not a fixed shape, and the twelfth shape may be variously changed according to the shape of a surface to be filled.

Figure 21:
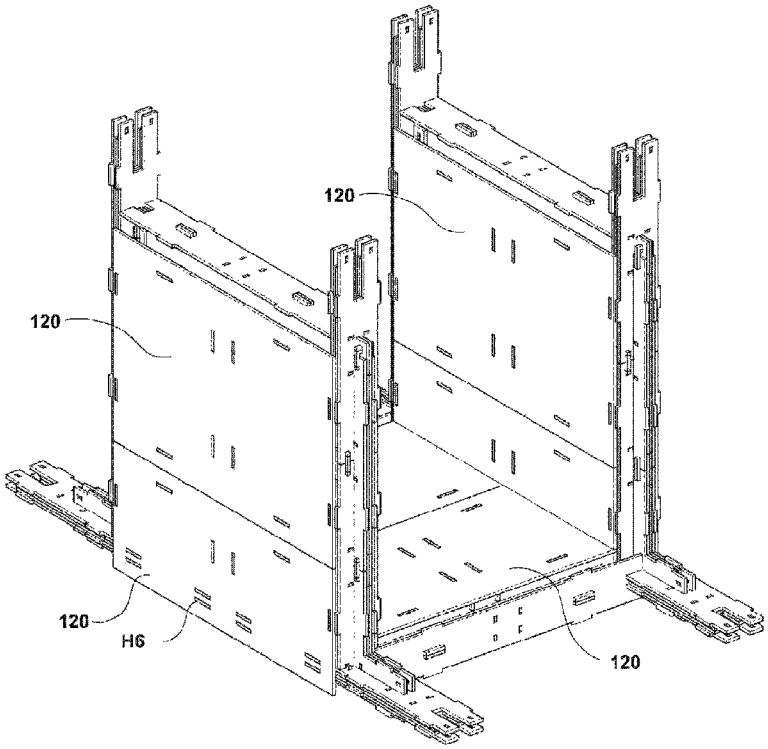
FIG. 21 is a perspective view of a wood structure building in which a plurality of 12th modules are inserted into a structure 4.
Figure 22:
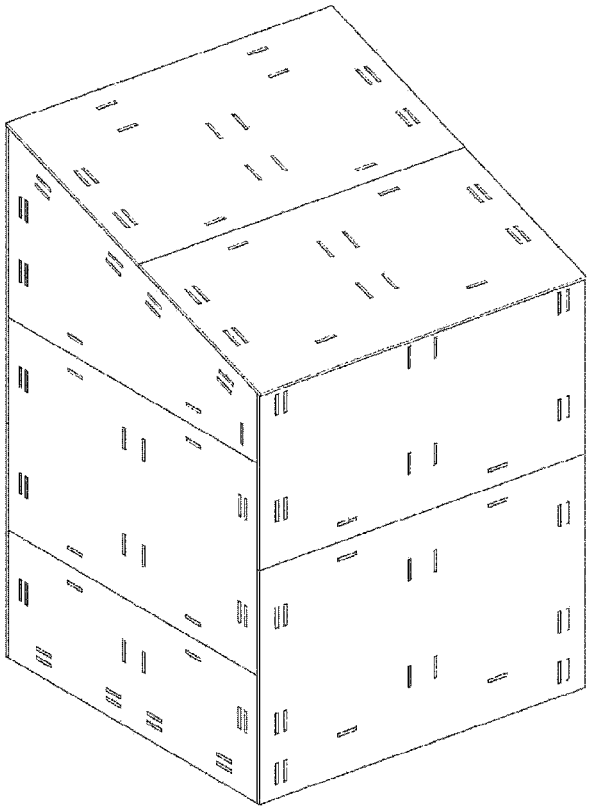
FIG. 22 is a perspective view of a completed building.

FIG. 21 is a perspective view of a wood structure building in which a plurality of 12th modules 120 have been inserted into structure 4. Thereafter, the general appearance of a building may be obtained by performing floor/wall work, finishing work, etc. FIG. 22 shows a perspective view of a building for which all processes have been completed.

So far, the self-building kit system 1000 according to the example embodiment of the present disclosure has been described. According to the present disclosure described above, a wood structure building may be completed through simple construction such as the fitting or insertion of various modules into or over each other. The present disclosure has the effects of enabling rapid construction and reducing the proportion of highly-paid expert carpenters by implementing a low level of construction difficulty that allows non-experts to participate in construction in the construction of a wood structure building. Furthermore, the present disclosure has the effect of eliminating the possibility that a variation in quality attributable to the skill of a constructor occurs because it is sufficient if various modules are fitted or inserted according to a design drawing of a wood structure building to be completed.

Finally, the shapes of the various modules shown in FIGS. 1 to 21 are illustrative. According to a design drawing of a wood structure building to be completed, the manufacturer of the self-building kit system 1000 according to the example embodiment of the present disclosure may manufacture modules suitable for it. Even in that case, the technical details described above are applied to the coupling between modules and the basic principles of the coupling.

MODE FOR CARRYING OUT THE INVENTION

While the example embodiments of the present disclosure have been described with reference to the accompanying drawings, those of ordinary skill in the art to which the present disclosure pertains may appreciate that the present disclosure may be implemented in other specific forms without changing the technical spirit or essential features of the present disclosure. Therefore, the example embodiments described above should be understood as illustrative and not limiting in all respects.

INDUSTRIAL APPLICABILITY

The features described above may be partially or entirely applicable to the construction industry.

The invention claimed is:

1. A self-building kit system comprising two first kits and a second kit, wherein:

each of the first kits comprises:

two first modules of a first shape, wherein the two first modules are spaced apart from each other, and each of the two first modules includes one or more first fitting portions cut out to a first length (d1) in a direction of a center thereof; and two second modules of a second shape, wherein the two second modules are disposed between the two first modules which are spaced apart from each other, and each of the two second modules includes one or more second fitting portions cut out to a second length (d2) in a direction of a center thereof, and wherein the second kit comprises:

two third modules of a third shape, wherein the two third modules are spaced apart from each other, and each of the two third modules includes one or more third fitting portions cut out to a third length (d3) in a direction of a center thereof; and two fourth modules of a fourth shape, wherein the two fourth modules are disposed between the two third modules which are spaced apart from each other, and each of the two fourth modules includes one or more fourth fitting portions cut out to a fourth length (d4) in a direction of a center thereof, and wherein the second length (d2) is equal to or shorter than the first length (d1), and the fourth length (d4) is equal to or shorter than the third length (d3), wherein each of the two first modules includes two or more first holes disposed in predetermined areas, and when the two first kits are fitted into both sides of the second kit with the second kit interposed therebetween, the two or more first holes included in the other of the two first kits, and wherein the first shape is different from the second shape, the self-building kit system further comprises a fifth module configured to be fitted into a space between the two or more first holes included in the one of the two first kits and a space between the two or more first holes included in the other of the two first kits in an empty space formed between the two first modules due to the difference between the first shape and the second shape, and the fifth module includes two or more second holes disposed in predetermined areas.

2. The self-building kit system of claim 1, wherein the first fitting portions included in each of the two first modules and the second fitting portions included in each of the two second modules are fitted into the third fitting portions included in each of the two third modules and the fourth fitting portions included in each of the two fourth modules, respectively, at an angle of 90°.

3. The self-building kit system of claim 1, wherein a sum of thicknesses of the two first modules and the two second modules is equal to a sum of thicknesses of the two third modules and the two fourth modules.

4. The self-building kit system of claim 1, further comprising:

a sixth module configured to be inserted into both the first hole selected from the two or more first holes included in the one of the two first kits and disposed in a direction of a first surface and the first hole selected from the two or more first holes included in the remaining one other of the two first kits and disposed in the direction of the first surface; and a seventh module configured to be inserted into both the first hole selected from the two or more first holes included in the one of the two first kits and disposed in a direction of a second surface and the first hole selected from the two or more first holes included in the other of the two first kits and disposed in the direction of the second surface.

5. The self-building kit system of claim 1, wherein:

the self-building kit system further comprises an eighth module of an eighth shape configured to be partially fitted into the space between the two or more first holes included in the one of the two first kits and the space between the two or more first holes included in the other of two first kits in the empty space formed between the two first modules due to the difference between the first shape and the second shape; and the eighth module includes:

two or more third holes disposed in a portion of the eighth module to be inserted; and one or more first protrusions disposed on outer peripheral surfaces of the eighth module.

6. The self-building kit system of claim 5, further comprising a ninth module of a ninth shape, including:

one or more fourth holes configured such that the first protrusions are inserted thereinto; and one or more fifth fitting portions cut out to a fifth length (d5) in a direction of a center thereof;

wherein the eighth module and the ninth module are disposed at an angle of 90°; and wherein the two first modules and the two second modules are fitted into the fifth fitting portions.

7. The self-building kit system of claim 1, further comprising any one or more of:

an 11th module of an 11th shape, including:

one or more third protrusions disposed on outer peripheral surfaces thereof, and one or more fourth protrusions disposed on the outer peripheral surfaces thereof; and a 12th module of a 12th shape, including:

one or more fifth protrusions disposed on outer peripheral surfaces thereof;

one or more sixth protrusions disposed on the outer peripheral surfaces thereof; and one or more sixth fitting portions cut out to a sixth length (d6) in a direction of a center thereof.

* * * * *